United States Patent [19]

Adamson, Jr.

[11] 3,976,281

[45] Aug. 24, 1976

[54] VARIABLE HEIGHT WORK SURFACE

[75] Inventor: James R. Adamson, Jr., Alexandria, Va.

[73] Assignee: The United States of America as represented by the Secretary of the Army, Washington, D.C.

[22] Filed: June 30, 1975

[21] Appl. No.: 591,926

[52] U.S. Cl. ..... 254/126; 269/60

[51] Int. Cl.[2] ..... B66F 3/00

[58] Field of Search ..... 254/124, 126, 127, 9 R, 254/9 B, 9 C; 269/60

[56] References Cited

UNITED STATES PATENTS

| | | | |
|---|---|---|---|
| 2,482,367 | 9/1949 | Ravers | 254/126 |
| 2,546,425 | 3/1951 | Broeker | 254/122 |
| 2,587,094 | 2/1952 | Berg et al. | 254/126 |
| 3,263,430 | 8/1966 | Bryan | 254/126 |

FOREIGN PATENTS OR APPLICATIONS

| | | | |
|---|---|---|---|
| 81,345 | 9/1920 | Austria | 254/126 |

OTHER PUBLICATIONS

Meyers, Ivan G., *Fluid Power: Key to Sophisticated Sawmill*, Hydraulics & Pneumatics, vol. 18: pp. 106–107, Nov. 1965.

*Primary Examiner*—Al Lawrence Smith
*Assistant Examiner*—Robert C. Watson
*Attorney, Agent, or Firm*—Nathan Edelberg; Milton W. Lee; Robert P. Gibson

[57] ABSTRACT

A variable height work surface easily and quickly adjustable from a low profile to a desired level by utilizing double acting scissor legs controlled by a screw drive mechanism.

1 Claim, 2 Drawing Figures

VARIABLE HEIGHT WORK SURFACE

The invention described herein may be manufactured, used, and licensed by or for the Government for governmental purposes without the payment to me of any royalty thereon.

BACKGROUND OF THE INVENTION

This invention disclosure relates to a variable height work surface for manufacturing, testing or display purposes. In working with laboratory and test equipment it quite often becomes necessary to align various pieces of equipment as well as to adjust the working plane of rather cumbersome and sometimes quite heavy pieces of equipment. Several vertical adjustment type laboratory tables are known in the art but adjustment in the vertical plane is rather inaccurate, tedious and difficult to achieve with the desired precision, particularly where the work surface is supporting a piece of equipment.

SUMMARY OF THE INVENTION

The disadvantages of the prior art devices have been effectively overcome by utilizing four sets of scissor type legs, one at each corner of the support surface, with the ends of each pivotally mounted to both the lower stationary base and the upper moveable work surface wherein the knee joints are connected to pressure transmission bars controlled by a screw drive mechanism for adjusting the height of the working plane while simultaneously exhibiting tremendous lifting capability and maintaining registration and rigidity.

BRIEF DESCRIPTION OF THE DRAWINGS

The exact nature of this invention will be readily apparent from consideration of the following specification relating to the annexed drawings wherein.

DESCRIPTION OF THE INVENTION

Figure 1:
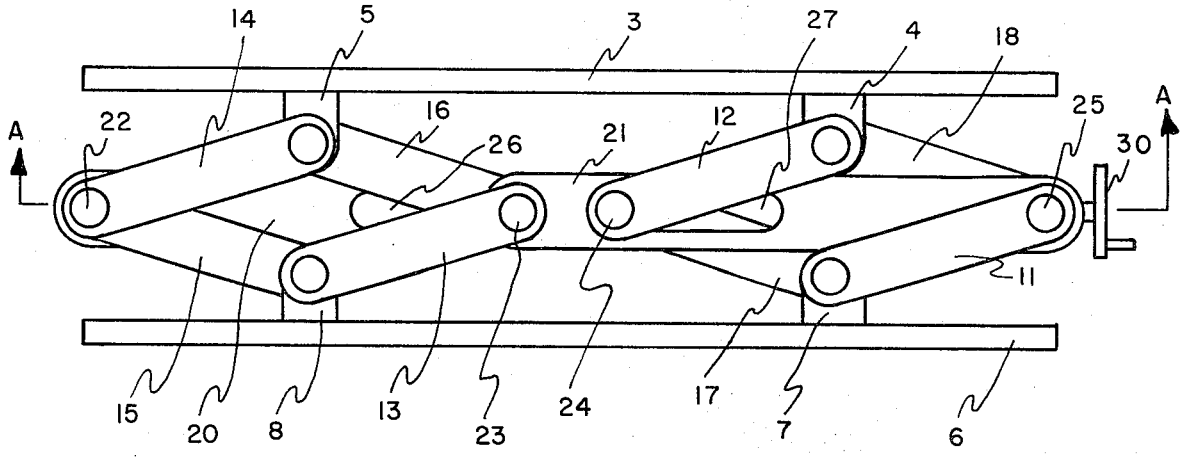
FIG. 1 shows a side view of the adjustable mechanism for the support stand.

Referring now to the drawings, wherein like reference characters designate like or corresponding parts throughout the several views, there is shown in FIG. 1 a side view of an adjustable work surface, laboratory stand, table or the like. The work surface 3 may be of any practical dimensions but ordinarily a work surface less than five or six inches square up to perhaps three or four feet square would be considered most desirable. Due to space limitations, the adjustable height of the work surface would be approximately one third the depth of the work surface. One could of course provide for greater height adjustment by designing longer scissor legs but when the work surface is lowered to a low profile, the knees of the scissor links would undesirably extend out beyond the edge of the work surface.

The scissor links or legs are pivotally attached to the work surface 3 and support base 6 by supports 4, 5 and 7, 8 respectively. Each leg consists of four links, such as 13, 14, 15 and 16. The uppermost links 14 and 16 are connected to support 5 with the lower most links 13 and 15 connected to support 8. The other ends of links 14 and 15 and 13 and 16 are connected at knee joints 22 and 23, respectively.

Figure 2:
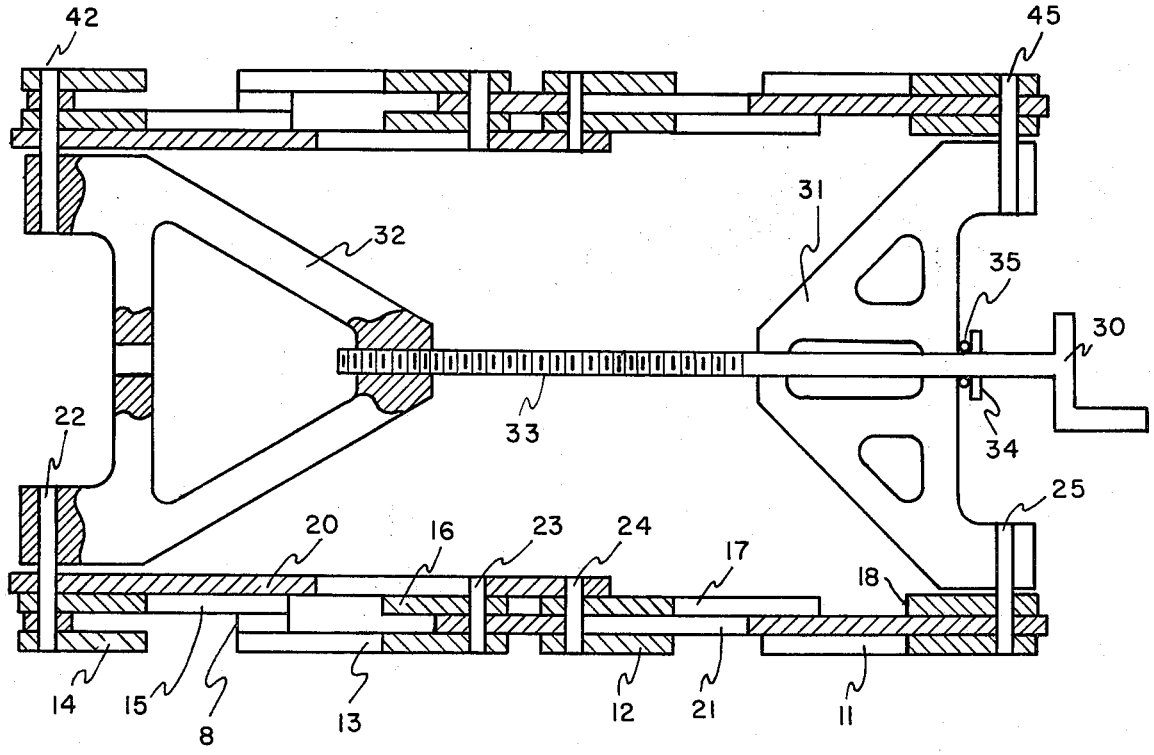
FIG. 2 shows a cut away top view of FIG. 1 at A—A.

Two reciprocating pressure transmission bars 20 and 21 are interconnected at the knee joints of the legs for effectively transmitting force to the knee joints by a screw drive mechanism shown in FIG. 2. Rotation of crank 30 adjusts the height of the working plane, as pressure is transmitted to the knee joints 22, 23, 24 and 25. Crank 30 actually consists of a double lead actuating screw shaft member 33, threadably engaged with member 32. A flange 34 is integrally attached to the shaft 33 and mates with a bearing means 35 such that upon rotation of crank 30, both frame members 31 and 32 will be either drawn closer together or forced apart. Frame members 31 and 32 are connected to the four sets of scissor legs by shaft members 22, 25, 42 and 45 which simultaneously apply pressure to the pressure transmission bars and to the knees of the scissor links. Pin 22 pivotally attaches the knee joint of links 14 and 15 to pressure transmission bar 20 while pin 23 pivotally attaches the knee joint of links 13 and 16 to pressure transmission bar 21 while simultaneously being slidably engaged in slot 26 of bar 20. Pin 24 pivotally attaches the knee of links 12 and 17 to the other end of pressure transmission bar 20 while being slidably engaged in slot 27 of bar 21. Pin 25 pivotally attaches the knee of links 11 and 18 to bar 21, thus effecting a double acting scissor adjusting mechanism.

As force is applied by crank 30, the knees at pins 22 and 23 as well as 24 and 25 are drawn closer together as frame members 31 and 32 are drawn closer together, applying a lateral force to pins 22 and 25 which applies a force to pressure transmission bars 20 and 21 which in turn apply lateral forces to pins 24 and 23 respectively. As the force is continually applied, to and by crank 30, the pressure transmission bars 20 and 21 force the knees at pins 24 and 23 in opposite directions, traversing the slots 27 and 26 respectively, thus raising the work surface.

The reverse or back side of the table functions identical to and simultaneous with the front side as described. While a certain preferred embodiment has been disclosed, it will be apparent to those skilled in the art that variations in specific details may be resorted to without departing from the spirit and scope of the invention as defined in the appended claims.

I claim:

1. A vertically adjustable stand comprising:

a work surface;

a base support means;

four scissor type, adjustable legs, each pivotally mounted to one corner of the work surface and the base support means, wherein each leg consists of four links with the ends of the first and second links pivotally connected to the work surface at a common point and the third and fourth links pivotally connected to the base support means at a common point, while the free ends of the first and third links and the second and fourth links, respectively, are interconnected to form outer and inner knee joints respectively, with each knee joint interconnecting respective links between the work and base support means;

two pairs of reciprocating pressure bars, whereby each pair of pressure bars simultaneously applies lateral pressure to the four knees of the scissor type leg arrangement on each side of the stand, each pair of pressure bars consisting of first and second reciprocating bars with each bar pivotally engaged with a respective outer knee joint of one leg and the inner knee joint of the other leg on either side of the stand, each pressure bar further containing an elongated slot intermediate the two pivotally engaged end portions thereof, wherein the inner knee joint connection of each scissor leg on either side of the stand is slideably engaged within the slot associated with the pressure bar pivotally engaged with the outer knee joint of each respective leg;

a pair of frame members intercoupled with a screw drive mechanism coupled to the reciprocating pressure bars at the outermost knee of each scissor leg; and a screw drive mechanism for applying inwardly directed lateral forces to said frame members which transmit similar forces to said reciprocating pressure bars allowing the pressure bars to exert lateral pressure at the knees of each scissor type leg, thus effectively adjusting the work surface to the desired level.

* * * * *